US010787787B2

(12) United States Patent
Abe et al.

(10) Patent No.: US 10,787,787 B2
(45) Date of Patent: Sep. 29, 2020

(54) HYDRAULIC SYSTEM FOR WORKING MACHINE

(71) Applicant: KUBOTA CORPORATION, Osaka (JP)

(72) Inventors: Daiki Abe, Osaka (JP); Yuji Fukuda, Osaka (JP); Yuya Konishi, Osaka (JP); Keigo Honda, Osaka (JP); Hiroya Hanano, Osaka (JP); Jun Tomita, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/430,969

(22) Filed: Jun. 4, 2019

(65) Prior Publication Data

US 2020/0048859 A1 Feb. 13, 2020

(30) Foreign Application Priority Data

Aug. 9, 2018 (JP) ..... 2018-150737

(51) Int. Cl.
*E02F 9/22* (2006.01)
*E02F 3/34* (2006.01)

(52) U.S. Cl.
CPC ..... *E02F 3/3414* (2013.01); *E02F 9/2221* (2013.01); *E02F 9/2267* (2013.01); *E02F 9/2282* (2013.01); *F15B 2211/20553* (2013.01)

(58) Field of Classification Search
CPC ..... E02F 3/3414; E02F 9/2221; E02F 9/2267; F15B 2211/20553
USPC ..... 60/427
See application file for complete search history.

(56) References Cited

U.S. PATENT DOCUMENTS

| | | | | |
|---|---|---|---|---|
| 9,316,310 | B2 * | 4/2016 | Kinugawa | F16H 61/421 |
| 2010/0236233 | A1 * | 9/2010 | Sumiyoshi | E02F 9/2232 60/445 |
| 2013/0092266 | A1 * | 4/2013 | Dhuri | B01D 19/0063 137/561 R |

FOREIGN PATENT DOCUMENTS

JP 2018105081 7/2018

* cited by examiner

*Primary Examiner* — Thomas E Lazo
*Assistant Examiner* — Daniel S Collins
(74) *Attorney, Agent, or Firm* — Greenblum & Bernstein, P.L.C.

(57) ABSTRACT

A hydraulic system for a working machine, includes an operation member, an operation valve to change an output pressure of an operation fluid in accordance with operation of the operation member, a hydraulic device to be activated by the operation fluid outputted from the operation valve, a first fluid tube coupling the operation valve to the hydraulic device, and a bleed circuit connected to the first fluid tube and configured to output the operation fluid in the first fluid tube. The first fluid tube includes a first section fluid tube arranged in a section between the operation valve and a coupling portion coupling the first fluid tube to the bleed circuit, and a second section fluid tube arranged in a section between the coupling portion and the hydraulic device, the second section fluid tube having an inner diameter different from an inner diameter of the first section fluid tube.

16 Claims, 4 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. 2018-150737, filed Aug. 9, 2018. The content of this application is incorporated herein by reference in their entirety.

BACKGROUND OF THE INVENTION

Field of the Invention

The present invention relates to a hydraulic system for a working machine such as a skid steer loader, a compact truck loader, and a backhoe, for example.

Description of Related Art

A hydraulic system for a working machine disclosed in Japanese Unexamined Patent Application Publication No. 2018-105081 is previously known as a technology for coupling a traveling pump to an operation valve. The hydraulic system for the working machine disclosed in Japanese Unexamined Patent Application Publication No. 2018-105081 includes a variable displacement pump, an operation configured to change a pressure of operation fluid in accordance with the operation of an operation member, and a traveling fluid tube coupling the operation valve to the variable displacement pump.

SUMMARY OF THE INVENTION

A hydraulic system for a working machine according to one aspect of the present invention, includes an operation member, an operation valve to change an output pressure of an operation fluid in accordance with operation of the operation member, a hydraulic device to be activated by the operation fluid outputted from the operation valve, a first fluid tube coupling the operation valve to the hydraulic device, and a bleed circuit connected to the first fluid tube and configured to output the operation fluid in the first fluid tube. The first fluid tube includes a first section fluid tube provided in a section between the operation valve and a coupling portion coupling the first fluid tube to the bleed circuit, and a second section fluid tube provided in a section between the coupling portion and the hydraulic device, the second section fluid tube having an inner diameter different from an inner diameter of the first section fluid tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
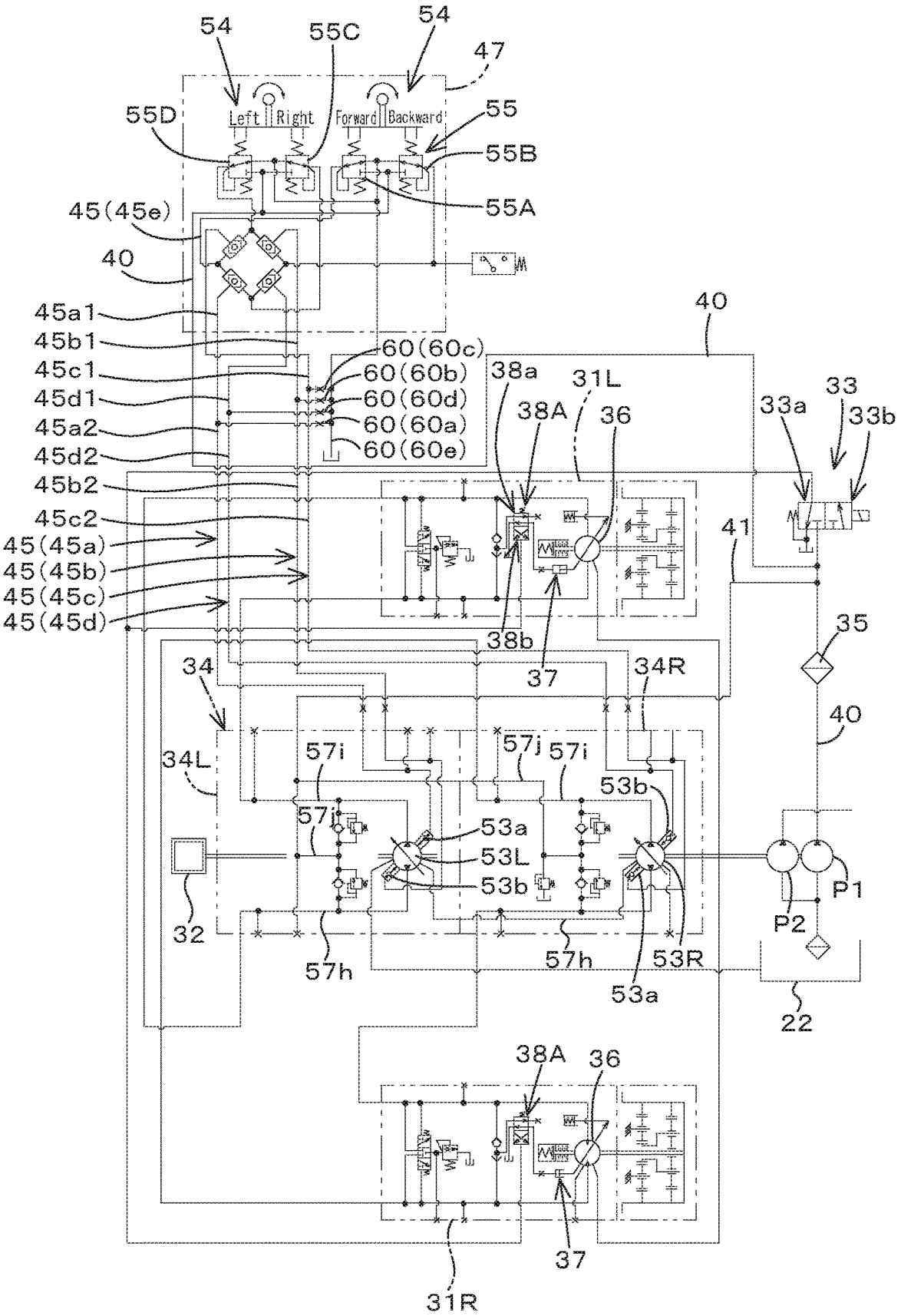
FIG. 1 is a view illustrating a hydraulic system (a hydraulic circuit) for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

An embodiment of a hydraulic system for a working machine and the working machine having the hydraulic system according to the present invention will be described below with reference to the drawings.

Figure 4:
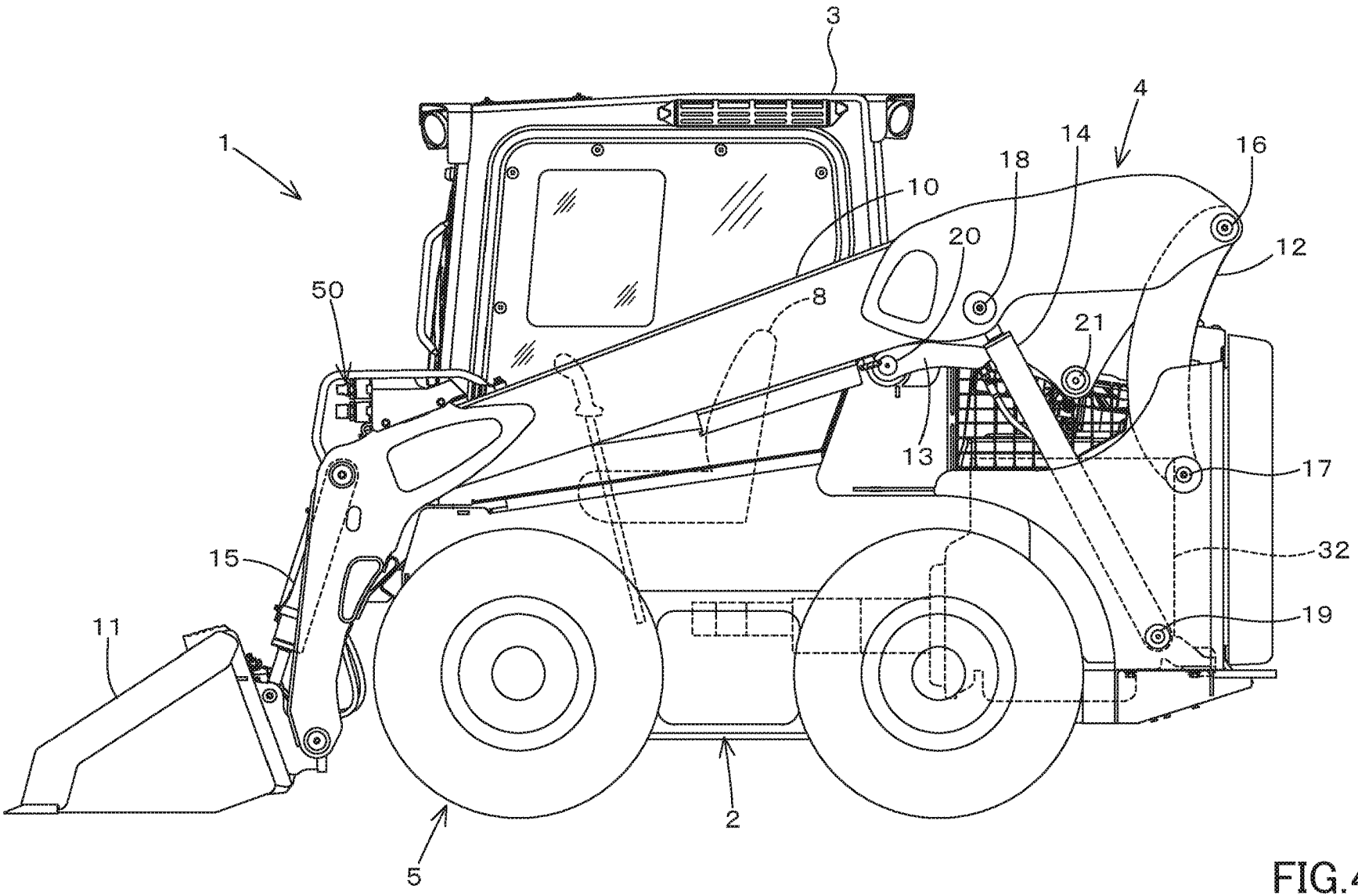
FIG. 4 is a side view illustrating a skid steer loader that is one example of the working machine according to the embodiment.

FIG. 4 shows a side view of a working machine according to an embodiment of the present invention. In FIG. 4, a skid steer loader is shown as an example of the working machine. However, the working machine according to the present invention is not limited to the skid steer loader, and may be, for example, another type of loader working machine such as a compact track loader. In addition, a working machine other than the loader working machine may be employed.

As shown in FIG. 4, the working machine 1 includes a machine body 2, a cabin 3, a working device 4, and a traveling device 5.

In the embodiment of the present invention, the front side (the left side in FIG. 4) of the operator seated on the operator seat 8 of the working machine 1 is referred to as the front, the rear side (the right side in FIG. 4) of the operator is referred to as the rear, the left side of the operator is referred to as the left, and the right side of the operator is referred to as the right.

Moreover in the explanation of the embodiment, the horizontal direction which is a direction orthogonal to the front-rear direction is referred to as a machine width direction. The direction extending from the central portion of the machine body 2 to the right portion or the left portion will be described as a machine outward direction. In other words, the machine outward direction corresponds to the machine width direction and is the direction separating away from the machine body 2.

A direction opposite to the machine outward direction will be described as a machine inward direction. In other words, the machine inward direction corresponds to the machine width direction and is the direction approaching the machine body 2.

The cabin 3 is mounted on the machine body 2. The cabin 3 is provided with an operator seat 8. The working device 4 is attached to the machine body 2. The traveling device 5 is provided on the outside of the machine body 2. A prime mover is mounted at the rear portion of the machine body 2.

The working device 4 includes a boom 10, a working tool 11, a lift link 12, a control link 13, a boom cylinder 14, and a bucket cylinder 15.

The boom 10 is provided on the right side of the cabin 3, and another boom 10 is provided on the left side of the cabin 3. The booms 10 is configured to be swung upward and downward. The working tool 11, for example, is a bucket, and the bucket 11 is provided at the tip end portions (the front end portions) of the booms 10 so as to be swung upward and downward.

The lift link 12 and the control link 13 support the base portion (the rear portion) of each of the booms 10 so that the boom 10 can be swung upward and downward. The boom cylinder 14 is stretched and shortened to move the boom 10 upward and downward. The bucket cylinder 15 is stretched and shortened to swing the bucket 11.

The front portions of the left boom 10 and the right boom 10 are coupled to each other by a deformed connecting pipe. The base portions (the rear portions) of the booms 10 are coupled to each other by a cylindrical connecting pipe.

A pair of the lift link 12, the control link 13 and the boom cylinder 14 is provided on the left side of the machine body 2 corresponding to the boom 10 arranged on the left side, and another pair of the lift link 12, the control link 13 and the boom cylinder 14 is provided on the right side of the machine body 2 corresponding to the boom 10 arranged on the right side.

The lift link 12 is provided vertically at the rear portion of the base portion of each of the booms 10. The upper portion (one end side) of the lift link 12 is supported rotatably about a lateral axis by a pivot shaft 16 (a first pivot shaft) near the rear portion of the base portion of each of the booms 10.

In addition, the lower portion (the other end side) of the lift link 12 is supported rotatably about the horizontal axis by a pivot shaft 17 (a second pivot shaft) near the rear portion of the machine body 2. The second pivot shaft 17 is provided below the first pivot shaft 16.

An upper portion of the boom cylinder 14 is supported rotatably about the lateral axis by a pivot shaft 18 (a third pivot shaft). The third pivot shaft 18 is provided at the base portion of each of the booms 10 and particularly at the front portion of the base portion.

The lower portion of the boom cylinder 14 is supported rotatably about the lateral axis by a pivot shaft 19 (a fourth pivot shaft). The fourth pivot shaft 19 is provided near the lower portion of the rear portion of the machine body 2 and below the third pivot shaft 18.

The control link 13 is provided in front of the lift link 12. One end of the control link 13 is supported rotatably about the lateral axis by a pivot shaft 20 (a fifth pivot shaft). The fifth pivot shaft 20 is provided at a position corresponding to the front of the lift link 12 in the machine body 2.

The other end of the control link 13 is supported rotatably about the lateral axis by a pivot shaft 21 (a sixth pivot shaft). The sixth pivot shaft 21 is provided in front of the second pivot shaft 17 and above the second pivot shaft 17 in the boom 10.

When the boom cylinder 14 is stretched and shortened, each of the booms 10 is swung upward and downward around the first pivot shaft 16 while the base portion of each of the booms 10 is supported by the lift link 12 and the control link 13. In this manner, the tip end portion of each of the booms 10 moves upward and downward.

The control link 13 is swung upward and downward around the fifth pivot shaft 20 in accordance with the upward and downward swinging of each of the booms 10. The lift link 12 is swung backward and forward around the second pivot shaft 17 in accordance with the upward and downward swinging of the control link 13.

Instead of the bucket 11, another working tool can be attached to the front portion of the boom 10. Another working tool is, for example, an attachment (an auxiliary attachment) such as a hydraulic crusher, a hydraulic breaker, an angle broom, an earth auger, a pallet fork, a sweeper, a mower, a snow blower, or the like.

A connecting member 50 is provided at the front portion of the boom 10 arranged on the left side. The connecting member 50 is a device for coupling a hydraulic device provided in the auxiliary attachment to a tube member such as a pipe provided to the boom 10.

In particular, the tube member can be connected to one end of the connecting member 50, and the tube member coupled to the hydraulic device of the auxiliary attachment can be coupled to the other end of the connecting member 50. In this manner, the operation fluid flowing in the tube material is supplied to the hydraulic device.

Each of the bucket cylinders 15 is respectively arranged near the front portion of each of the booms 10. When the bucket cylinder 15 is stretched and shortened, the bucket 11 is swung.

In the present embodiment, a wheel-type traveling device having a front wheel and a rear wheel is adopted as each of the traveling device 5 arranged on the right and the traveling devices 5 arranged on the left. The traveling device may employ a crawler type traveling device (including a semi-crawler type traveling device).

Next, the hydraulic system for the working machine according to the embodiment of present invention will be described below.

As shown in FIG. 1, the hydraulic system of the traveling system is a system configured to drive the traveling device 5. The traveling device 5 includes a left traveling motor device (a first traveling motor device) 31L, a right traveling motor device (a second traveling motor device) 31R, and a hydraulic device 34. The hydraulic system of the traveling system includes a prime mover 32, a direction switching valve 33, and a first hydraulic pump P1.

The prime mover 32 is constituted of an electric motor, an engine, or the like. In the embodiment, the prime mover 32 is constituted of the engine. The first hydraulic pump P1 is a pump configured to be driven by the power of the prime mover 32, and is constituted of a constant displacement gear pump. The first hydraulic pump P1 is configured to output the operation fluid stored in the tank 22.

In particular, the first hydraulic pump P1 outputs the operation fluid mainly used for control. For convenience of the explanation, the tank 22 for storing the operation fluid may be referred to as an operation fluid tank.

Further, of the operation fluid outputted from the first hydraulic pump P1, the operation fluid used for control may be referred to as a pilot fluid, and the pressure of the pilot fluid may be referred to as a pilot pressure.

An output fluid tube 40 for supplying the operation fluid (the pilot fluid) is provided on the output side of the first hydraulic pump P1. The output fluid tube (a second fluid tube) 40 is provided with a filter 35, a direction switching valve 33, a first travel motor device 31L, and a second travel motor device 31R.

Between the filter 35 and the direction switching valve 33, a charging fluid tube 41 branched from the output fluid tube 40 is provided. The charging fluid tube 41 reaches the hydraulic device 34.

The direction switching valve 33 is an electromagnetic valve configured to change the revolutions of the first travel motor device 31L and the second travel motor device 31R, and particularly is a two-position switching valve that can be magnetized to be switched between the first position 33*a* and the second position 33*b*. The switching operation of the direction switching valve 33 is performed by an operation member or the like (not shown in the drawings).

The first travel motor device 31L is a motor for transmitting power to the drive shaft of the traveling device 5 provided on the left side of the machine body 2. The second travel motor device 31R is a motor for transmitting power to the drive shaft of the traveling device provided on the right side of the machine body 2.

The first traveling motor device 31L includes an HST motor (a traveling motor) 36, a swash plate switching cylinder 37, and a traveling control valve (a hydraulic switching valve) 38.

The HST motor 36 is constituted of a swash plate type variable displacement axial motor, that is, a motor configured to change the vehicle speed (the revolution) to the first speed or the second speed. In other words, the HST motor 36 is a motor configured to change the thrust power of the working machine 1.

The swash plate switching cylinder 37 is a cylinder configured to be stretched and shortened to change the angle of the swash plate of the HST motor 36. The travel control valve 38 is a valve configured to stretch and shortens the swash plate switching cylinder 37 to one side or the other side, that is, a two-position switching valve configured to be switched between the first position 38*a* and the second position 38*b*.

The switching operation of the travel control valve 38 is performed by the direction switching valve 33 located on the upstream side connected to the travel control valve 38.

As described above, according to the first travel motor device 31L, when the direction switching valve 33 is set to the first position 33*a* through the operation of the operation member, the pilot fluid is released in the section between the direction switching valve 33 and the travel control valve 38, and thereby the travel control valve 38 is switched to the first position 38*a*. As the result, the swash plate switching cylinder 37 is shortened, and the HST motor 36 is set to be in the first speed.

In addition, when the direction switching valve 33 is set to the second position 33*b* through the operation of the operation member, the pilot fluid is supplied to the travel control valve 38 through the direction switching valve 33, and the travel control valve 38 is switched to the second position 38*b*. As the result, the swash plate switching cylinder 37 is stretched, and the HST motor 36 is set to be in the second speed.

The second travel motor device 31R also operates in the same manner as the first travel motor device 31L. The configuration and operation of the second travel motor device 31R are the same as those of the first travel motor device 31L, and thus the description thereof is omitted.

The hydraulic device 34 is a device configured to drive the first travel motor device 31L and the second travel motor device 31R, and includes a drive circuit (a drive circuit for the left) 34L for driving the first travel motor device 31L and a drive circuit (a drive circuit for the right) 34R for driving the second travel motor device 31R.

The drive circuits 34L and 34R respectively include the HST pumps (the traveling pumps) 53L and 53R, the speed-changing fluid tubes 57*h* and 57*i*, and the second charging fluid tube 57*j*. The speed-changing fluid tubes 57*h* and 57*i* are fluid tubes coupling the HST pumps 53L and 53R to the HST motor 36.

The second charge fluid tube 57*j* is a fluid tube connected to the speed-changing fluid tubes 57*h* and 57*i*, and configured to refill, to the speed-changing fluid tubes 57*h* and 57*i*, the operation fluid outputted from the first hydraulic pump P1.

The HST pumps 53L and 53R are the swash plate type variable displacement axial pumps configured to be driven by the power of the prime mover 32. The HST pumps 53L and 53R each have the forward-traveling pressure receiving portions 53*a* and the backward-traveling pressure receiving portions 53*b* on which the pilot pressures are applied. The angles of the swash plates of the HST pumps 53L and 53R are changed by the pilot pressure applied to the pressure receiving portions 53*a* and 53*b*.

The HST pumps 53L and 53R are configured to change the angles of the swash plates to change the outputs (the output amounts of operation fluid) of the HST pumps 53L and 53R and the output directions of the operation fluids.

The outputs of the HST pumps 53L and 53R and the output direction of the operation fluid can be changed by the operation device 47 provided around the operator seat 8. The operation device 47 has an operation member 54 supported swingably and a plurality of pilot valves (operation valves) 55.

As shown in FIG. 1, the operation member 54 is an operation lever supported by the operation valve 55 and configured to be swung in the lateral direction (in the machine width direction) or in the front-rear direction. That is, with respect to the neutral position N, the operation member 54 can be operated rightward and leftward from the neutral position N and can be operated forward and backward from the neutral position N.

In other words, the operation member 54 can be swung in at least four directions with respect to the neutral position N.

For convenience of the explanation, the two directions, the forward direction and the backward direction, that is, the front-rear direction will be referred to as a first direction. In addition, the two directions, the right direction and the left direction, that is, the lateral direction (the machine width direction) may be referred to as a second direction.

Further, the plurality of operation valves 55 are operated by a common operation member, that is, a single of the operation member 54. The plurality of operation valves 55 operate based on the swinging operation of the operation member 54. An output fluid tube 40 is connected to the plurality of operation valves 55, and the operation fluid (the pilot fluid) can be supplied from the first hydraulic pump P1 through the output fluid tube 40.

The plurality of control valves 55 include a operation valve 55A, a operation valve 55B, a operation valve 55C, and a operation valve 55D.

The operation valve 55A changes the pressure of the outputted operation fluid in accordance with the operation extent of the forward operation (the movement) when the operation lever 54 is swung forward (to one side) in the front-rear direction (the first direction) (when the forward operation is performed).

The operation valve 55B changes the pressure of the outputted operation fluid in accordance with the operation extent of the backward operation (the movement) when the operation lever 54 is swung backward (to the other side) in the front-rear direction (the first direction) (when the backward operation is performed).

The operation valve 55C changes the pressure of the outputted operation fluid in accordance with the operation extent of the rightward operation (the movement) when the operation lever 54 is swung rightward (to one side) in the lateral direction (the second direction) (when the rightward operation is performed).

The operation valve 55D changes the pressure of the outputted operation fluid in accordance with the operation extent of the leftward operation (the movement) when the operation lever 54 is swung leftward (to the other side) in the lateral direction (the second direction) (when the leftward operation is performed).

The plurality of operation valves 55 are coupled to the hydraulic devices 34 (the traveling pump 53L and the traveling pump 53R) of the traveling system by a plurality of traveling fluid tubes (the first fluid tubes) 45. In other words, the traveling pump 53L and the traveling pump 53R are hydraulic devices each configured to be operated by the operation fluid outputted from the operation valves 55 (the operation valve 55A, the operation valve 55B, the operation valve 55C, and the operation valve 55D).

In addition, the plurality of operation valves 55 are coupled to the first hydraulic pump P1 by an output fluid tube (a second fluid tube) 40.

The plurality of traveling fluid tubes 45 include a first traveling fluid tube 45*a*, a second traveling fluid tube 45*b*, a third traveling fluid tube 45*c*, a fourth traveling fluid tube 45*d*, and a fifth traveling fluid tube 45*e*.

The first traveling fluid tube 45*a* is a fluid tube connected to the forward-traveling pressure receiving portion 53*a* of the traveling pump 53L. The second traveling fluid tube 45*b* is a fluid tube connected to the backward-traveling pressure receiving portion 53*b* of the traveling pump 53L.

The third traveling fluid tube 45*c* is a fluid tube connected to the forward-traveling pressure receiving portion 53*a* of the traveling pump 53R. The fourth traveling fluid tube 45*d* is a fluid tube connected to the backward-traveling pressure receiving portion 53*b* of the traveling pump 53R.

The fifth traveling fluid tube 45*e* is a fluid tube coupling the operation valve 55, the first traveling fluid tube 45*a*, the second traveling fluid tube 45*b*, the third traveling fluid tube 45*c*, and the fourth traveling fluid tube 45*d*.

The fifth traveling fluid tube 45*e* includes a bridge portion 45*e*1 having a plurality of shuttle valves 46, and a coupling tube 45*e*2 coupling the operation valve 55 to the confluent portion of the bridge portion 45*e*1.

When the operation lever 54 is swung forward (in the direction indicated by an arrowed line A1 in FIG. 1), the operation valve 55A is operated to output a pilot pressure from the operation valve 55A.

The pilot pressure is applied to the pressure receiving portion 53*a* of the traveling pump 53L through the first traveling fluid tube 45*a*, and is applied to the pressure receiving portion 53*a* of the traveling pump 53R through the third traveling fluid tube 45*c*. In this manner, the output shaft of the travel motor 36 revolves forward (the forward revolution) at a speed proportional to the swinging extent of the operation lever 54, and thereby the working machine 1 travels straight forward.

In addition, when the operation lever 54 is swung backward (in the direction indicated by an arrowed line A2 in FIG. 1), the operation valve 55B is operated to output a pilot pressure from the operation valve 55B.

The pilot pressure is applied to the pressure receiving portion 53*b* of the traveling pump 53L through the second traveling fluid tube 45*b*, and is applied to the pressure receiving portion 53*b* of the traveling pump 53R through the fourth traveling fluid tube 45*d*. In this manner, the output shaft of the traveling motor 36 revolves backward (the backward revolution) at a speed proportional to the swinging extent of the operation lever 54, and thereby the working machine 1 travels straight forward.

In addition, when the operation lever 54 is swung rightward (in the direction indicated by an arrowed line A3 in FIG. 1), the operation valve 55C is operated to output a pilot pressure from the operation valve 55C.

The pilot pressure is applied to the pressure receiving portion 53*a* of the traveling pump 53L through the first traveling fluid tube 45*a*, and is applied to the pressure receiving portion 53*b* of the traveling pump 53R through the fourth traveling fluid tube 45*d*. In this manner, the output shaft of the traveling motor 36 arranged on the left revolves forward and the output shaft of the traveling motor 36 arranged on the right revolves backward, and thereby the working machine 1 turns rightward.

In addition, when the operation lever 54 is swung leftward (in the direction indicated by an arrowed line A4 in FIG. 1), the operation valve 55D is operated to output a pilot pressure from the operation valve 55D.

The pilot pressure is applied to the pressure receiving portion 53*a* of the traveling pump 53R through the third traveling fluid tube 45*c*, and is applied to the pressure receiving portion 53*b* of the traveling pump 53L through the second traveling fluid tube 45*b*. In this manner, the output shaft of the traveling motor 36 arranged on the left revolves backward and the output shaft of the traveling motor 36 arranged on the right revolves forward, and thereby the working machine 1 turns leftward.

In addition, when the operation lever 54 is swung in an oblique direction, the pressure difference between the pilot pressures applied to the pressure receiving portion 53*a* and the pressure receiving portion 53*b* determines the revolution direction and the revolution speed of the output shafts of the traveling motor 36 arranged on the left and the traveling motor 36 arranged on the right. The working machine 1 turns right or left while traveling forward or backward.

That is, when the operation lever 54 is operated to be swung obliquely forward to the left, the working machine 1 turns left while traveling forward at a speed corresponding to the swing angle of the operation lever 54. When the operation lever 54 is operated to be swung obliquely forward to the right, the working machine 1 turns right while traveling forward at a speed corresponding to the swing angle of the operation lever 54.

When the operation lever 54 is operated to be swung obliquely backward to the left, the working machine 1 turns left while traveling backward at a speed corresponding to the swing angle of the operation lever 54. When the operation lever 54 is operated to be swung obliquely backward to the right, the working machine 1 turns right while traveling backward at a speed corresponding to the swing angle of the operation lever 54.

Figure 2:
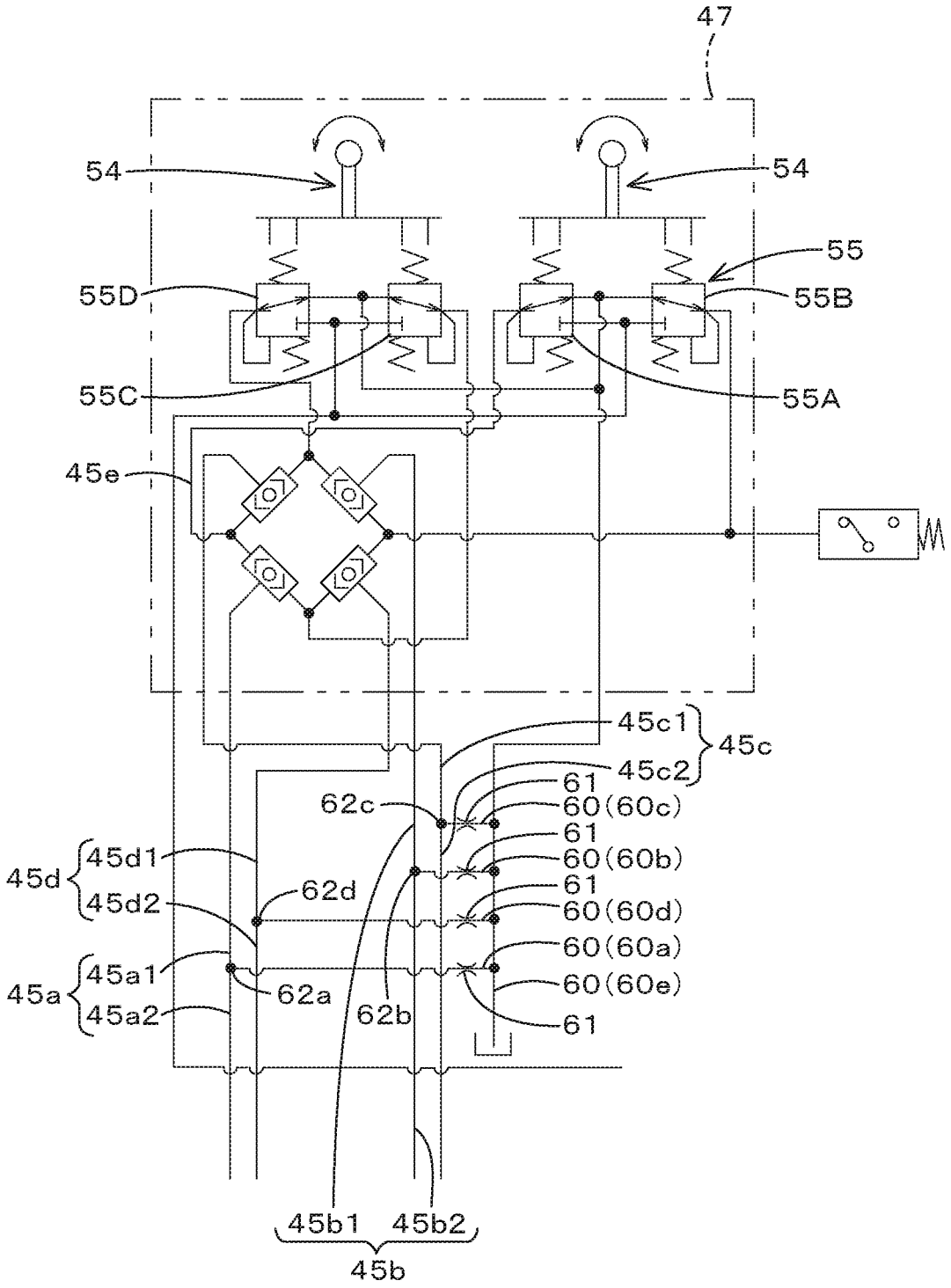
FIG. 2 is an enlarged view of a first fluid tube and a second fluid tube according to the embodiment.

As shown in FIG. 1 and FIG. 2, a plurality of bleed circuits (fluid tubes) 60 are connected to the plurality of traveling fluid tubes 45. The bleed circuit 60 includes a first bleed circuit 60*a*, a second bleed circuit 60*b*, a third bleed circuit 60*c*, and a fourth bleed circuit 60*d*.

The first bleed circuit 60*a* is a fluid tube connected to the first traveling fluid tube 45*a*. The second bleed circuit 60*b* is a fluid tube connected to the second traveling fluid tube 45*b*.

The third bleed circuit 60*c* is a fluid tube connected to the third traveling fluid tube 45*c*. The fourth bleed circuit 60*d* is a fluid tube connected to the fourth traveling fluid tube 45*d*.

Each of the first bleed circuit 60*a*, the second bleed circuit 60*b*, the third bleed circuit 60*c*, and the fourth bleed circuit 60*d* is provided with a throttle portion 61 for reducing the flow rate of the hydraulic fluid.

The first bleed circuit 60*a*, the second bleed circuit 60*b*, the third bleed circuit 60*c*, and the fourth bleed circuit 60*d* are joined in one, and the joined bleed circuit 60*e* after the joining reaches a discharge portion for discharging the operation fluid stored in the tank 22 or the like. Thus, it is possible to release the air from the traveling fluid tube 45, for example.

Here, focusing on the coupling portion 62*a* between the first traveling fluid tube 45*a* and the first bleed circuit 60*a*, on the coupling portion 62*b* between the second traveling fluid tube 45*b* and the second bleed circuit 60*b*, on the coupling portion 62*c* between the third traveling fluid tube 45*c* and the third bleed circuit 60*c*, and on the coupling portion 62*d* between the fourth traveling fluid tube 45*d* and the third bleed circuit 60*d*, the inner diameters of the upstream sides of the plurality of traveling fluid tubes 45 (45*a*, 45*b*, 45*c*, 45*d*) are different from the inner diameters of the downstream sides of the plurality of traveling fluid tubes 45 (45*a*, 45*b*, 45*c*, 45*d*) in comparison with the coupling portion 62*a*, the coupling portion 62*b*, the coupling portion 62*c*, and the coupling portion 62*d*.

In particular, the first traveling fluid tube 45*a* has a first section fluid tube 45*al* arranged on the upstream side of the coupling portion 62*a* and a second section fluid tube 45*a*2 arranged on the downstream side of the coupling portion 62*a*. The inner diameter UR1 of the first section fluid tube 45*a*1 is different from the inner diameter DR1 of the second section fluid tube 45*a*2. The inner diameter UR1 is larger than the inner diameter DR1.

Similarly, the second traveling fluid tube 45*b* has a first section fluid tube 45*b*1 arranged on the upstream side of the coupling portion 62*b* and a second section fluid tube 45*b*2 arranged on the downstream side of the coupling portion 62*b*. The inner diameter UR2 of the first section fluid tube 45*b*1 is different from the inner diameter DR2 of the second section fluid tube 45*b*2. The inner diameter UR2 is larger than the inner diameter DR2.

The third traveling fluid tube 45*c* has a first section fluid tube 45*c*1 arranged on the upstream side of the coupling portion 62*c* and a second section fluid tube 45*c*2 arranged on the downstream side of the coupling portion 62*c*. The inner diameter UR3 of the first section fluid tube 45*c*1 is different from the inner diameter DR3 of the second section fluid tube 45*c*2. The inner diameter UR3 is larger than the inner diameter DR3.

The fourth traveling fluid tube 45*d* has a first section fluid tube 45*d*1 arranged on the upstream side of the coupling portion 62*d* and a second section fluid tube 45*d*2 arranged on the downstream side of the coupling portion 62*d*. The inner diameter UR4 of the first section fluid tube 45*d*1 is different from the inner diameter DR4 of the second section fluid tube 45*d*2. The inner diameter UR4 is larger than the inner diameter DR4.

As described above, in the case where the connection portions (the coupling portion 62*a*, the coupling portion 62*b*, the coupling portion 62*c*, and the coupling portion 62*d*) to which the plurality of bleed circuits 60 are considered as starting points in the plurality of traveling fluid tubes 45, the inner diameters UR (UR1 to UR4) of the first section fluid tubes 45*a*1, 45*b*1, 45*c*1 and 45*d*1 which are fluid tubes arranged on the upstream side are larger than the inner diameters DR (DR1 to DR4) of the second section fluid tubes 45*a*2, 45*b*2, 45*c*2, and 45*d*2 which are fluid tubes arranged on the downstream side.

Here, as for the inner diameters UR (UR1 to UR4) of the first section fluid tubes 45*a*1, 45*b*1, 45*c*1 and 45*d*1, the inner diameters DR (DR1 to DR4) of the second section fluid tubes 45*a*2, 45*b*2, 45*c*2 and 45*d*2, and the inner diameter PR of the output fluid tube 40, the inner diameter PR is equal to or larger than the inner diameters UR, and the inner diameters UR are larger than the inner diameters DR.

In addition, the inside diameters (the cross-sectional area through which the operation fluid flows) of the throttle portions 61 provided in the first bleed circuit 60*a*, the second bleed circuit 60*b*, the third bleed circuit 60*c*, and the fourth bleed circuit 60*d* are indicated as inner diameters OR. In that case, as for a relation between the inner diameter OR of the throttle portion 61, the inner diameters UR (UR1 to UR4) of the first section fluid tubes 45*a*1, 45*b*1, 45*c*1 and 45*d*1, and the inner diameters DR (DR1 to DR4) of the second section fluid tubes 45*a*2, 45*b*2, 45*c*2 and 45*d*2, the inner diameter PR is equal to or more than the inner diameters UR, the inner diameters UR are larger than the inner diameters DR, and the inner diameters DR are larger than the inner diameters OR.

The hydraulic system for the working machine includes the operation member 54, the operation valve 55 to change an output pressure of the operation fluid in accordance with the operation of the operation member 54, the hydraulic device 34 (the traveling pump 53L and the traveling pump 53R) to be activated by the operation fluid outputted from the operation valve 55, the travel fluid tube (the first fluid tube) 45 coupling the operation valve 55 to the hydraulic device 34 (the traveling pump 53L and the traveling pump 53R), and the bleed circuit 60 connected to the travel fluid tube (the first fluid tube) 45 and configured to output the operation fluid in the travel fluid tube (the first fluid tube) 45. The travel fluid tube (the first fluid tube) 45 includes the first section fluid tubes 45*a*1, 45*b*1, 45*c*1, and 45*d*1 provided in a section between the operation valve 55 and the coupling portions 62*a*, 62*b*, 62*c*, and 62*d* coupling the travel fluid tube (the first fluid tube) 45 to the bleed circuit 60, and the second section fluid tubes 45*a*2, 45*b*2, 45*c*2, and 45*d*2 provided in a section between the coupling portions 62*a*, 62*b*, 62*c*, and 62*d* and the hydraulic device 34 (the traveling pump 53L and the traveling pump 53R), the second section fluid tubes 45*a*2, 45*b*2, 45*c*2, and 45*d*2 each having the inner diameters different from the inner diameters of the first section fluid tubes 45*a*1, 45*b*1, 45*c*1, and 45*d*1.

According to that configuration, the flow rates of the operation fluids flowing in the first section fluid tubes 45*a*1, 45*b*1, 45*c*1, and 45*d*1 which are arranged on the upstream sides of the coupling portions 62*a*, 62*b*, 62*c*, and 62*d* for connecting the bleed circuit 60 can be different from the flow rates of the operation fluids flowing in the second section fluid tubes 45*a*2, 45*b*2, 45*c*2, and 45*d*2 which are arranged on the downstream sides of the coupling portions 62*a*, 62*b*, 62*c*, and 62*d*.

In this manner, the first section fluid tubes 45*a*, 45*b*1, 45*c*1, and 45*d*1 and the second section fluid tubes 45*a*2, 45*b*2, 45*c*2, and 45*d*2 form a fluid passage suitable for the balance of the operation fluids flowing toward the hydraulic device. Thus, the operation fluid can be adequately supplied to the hydraulic device.

The inner diameters UR of the first section fluid tubes 45*a*1, 45*b*1, 45*c*1, and 45*d*1 are larger than the inner diameters DR of the second section fluid tubes 45*a*2, 45*b*2, 45*c*2, and 45*d*2. In this manner, in the travel fluid tube 45, the inner diameters DR of the second section fluid tubes 45*a*2, 45*b*2, 45*c*2, and 45*d*2 arranged on the downstream side can have a size corresponding to the bleed circuit 60.

That is, the tube members such as the hoses constituting the second section fluid tubes 45*a*2, 45*b*2, 45*c*2 and 45*d*2 can be made smaller than the tube members constituting the first section fluid tubes 45*a*1, 45*b*1, 45*c*1 and 45*d*1. Thus, it is possible to reduce the arrangement space for placement of the tube members, and to improve the freedom of the piping arrangement.

The hydraulic system for the working machine includes the hydraulic pump P1 configured to output the operation fluid, and the output fluid tube (the second fluid tube) 40 coupling the hydraulic pump P1 to the operation valve 55 and having an inner diameter larger than inner diameters of the second section fluid tubes 45*a*2, 45*b*2, 45*c*2, and 45*d*2.

According to that configuration, the inner diameter of the output fluid tube 40 arranged on the side to supply the operation fluid to the operation valve 55, and additionally the second section fluid tubes 45*a*2, 45*b*2, 45*c*2, and 45*d*2 can be made smaller, the second section fluid tubes 45*a*2, 45*b*2, 45*c*2, and 45*d*2 requiring to have a relatively small flow rate of the operation fluid.

Thus, the flow rate of the hydraulic fluid entering the operation valve 55 is ensured, and additionally the flow rate of the operation fluid from the operation valve 55 on the downstream side can be made the flow rate necessary for the hydraulic devices 34 (the traveling pumps 53L and 53R). In this manner, the hydraulic device 34 can be operated efficiently.

As for the inner diameters UR of the first section fluid tubes, the inner diameters DR of the second section fluid tubes, and the inner diameter PR of the output fluid tube (the second fluid tube) 40, the inner diameter PR is equal to or larger than the inner diameters UR, and the inner diameters UR are larger than the inner diameters DR. According to that configuration, a balance between the flow rate of the operation fluid to be supplied to the operation valve 55, the flow rate of the operation fluid outputted from the operation valve 55, and the flow rate of a part of the operation fluid discharged from the bleed circuit 60 toward the hydraulic devices 34 (the traveling pump 53L and the traveling pump 53R) can be optimized. Thus, the hydraulic device 34 can be operated efficiently.

Figure 3:
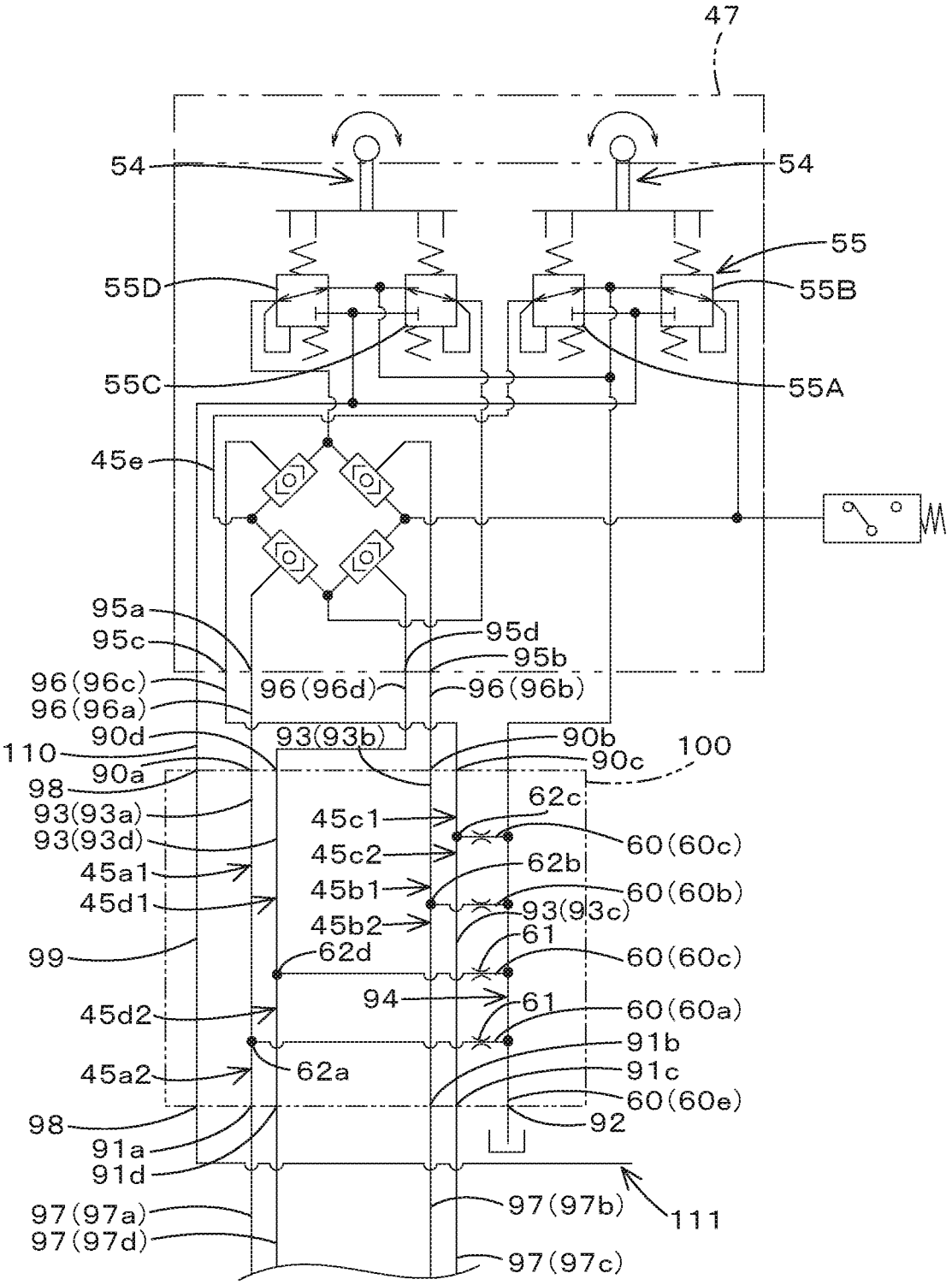
FIG. 3 is an enlarged view illustrating a configuration provided with a relay member according to the embodiment.

Then, FIG. 3 shows a hydraulic system provided with a relay member. Hereinafter, the relationship between the fluid tubes of the case where of constituting the hydraulic system including the relay member will be described.

The relay member 100 is configured by forming the fluid passages (an internal flow passage 93, and a discharge flow passage 94) inside a metal block or the like. The relay member 100 includes a plurality of input ports 90*a*, 90*b*, 90*c*, and 90*d*, a plurality of output ports 91*a*, 91*b*, 91*c*, and 91*d*, and a discharge port 92.

The internal flow passage 93 is communicated with the plurality of input ports 90*a*, 90*b*, 90*c*, and 90*d*. And, the discharge flow passage 94 is communicated with the discharge port 92.

More specifically, the plurality of internal flow passage 93 includes an internal flow tube 93*a* to communicate the input port 90*a* with the output port 91*a*, an internal flow tube 93*b* to communicate the input port 90*b* with the output port 91*b*, and an internal flow tube 93*c* to communicate the input port 90*c* with the output port 91*c*, and an internal flow tube 93*d* to communicate the input port 90*d* with the output port 91*d*.

The discharge flow passages 94 are branched from the plurality of internal flow passages 93 (93*a*, 93*b*, 93*c*, and 93*d*), and are communicated with the discharge port 92.

The plurality of input ports 90*a*, 90*b*, 90*c*, and 90*d* are coupled to the operation device 47 (the operation valve 55) by a plurality of first tube members 96. The plurality of first tube members 96 are pipes (hoses) or the like, and couple the output ports 95*a*, 95*b*, 95*c*, and 95*d* of the operation device 47 to the input ports 90*a*, 90*b*, 90*c*, and 90*d* of the relay member 100.

In particular, the plurality of first tube members 96 include a first tube member 96*a* coupling the input port 90*a* to the output port 95*a*, a first tube member 96*b* coupling the input port 90*b* to the output port 95*b*, a first tube member 96*c* coupling the input port 90*c* to the output port 95*c*, and a first tube member 96*d* coupling the input port 90*d* to the output port 95*d*.

The plurality of output ports 91*a*, 91*b*, 91*c*, and 91*d* are coupled to the hydraulic devices 34 (the traveling pumps 53L and 53R) by a plurality of second tube members 97. The plurality of second tube members 97 are pipes (hoses) or the like, and couple the pressure receiving portions 53*a* and 53*b* of the traveling pumps 53L and 53R to the output ports 91*a*, 91*b*, 91*c*, and 91*d* of the relay member 100.

In particular, the plurality of second tube members 97 include a second tube member 97*a* coupling the output port 91*a* to the pressure receiving portion 53*a* of the traveling pump 53L, a second tube member 97*b* coupling the output port 91*b* to the pressure receiving portion 53*b* of the traveling pump 53L, a second tube member 97*c* coupling the output port 91*c* to the pressure receiving portion 53*a* of the traveling pump 53R, and a second tube member 97*d* coupling the output port 91*d* to the pressure receiving portion 53*b* of the traveling pump 53R.

As described above, when the operation valve 55 is coupled to the traveling pumps 53L and 53R by the relay member 100, the plurality of first tube members 96, and the plurality of second tube members 97, the first section fluid tube 45*a*1 includes the first tube member 96*a* and the inner flow passage (inner flow tube) 93*a*, the first section fluid tube 45*b*1 includes the first tube member 96*b* and the inner flow passage (inner flow tube) 93*b*, the first section fluid tube 45*c*1 includes the first tube member 96*c* and the inner flow passage (inner flow tube) 93*c*, and the first section fluid tube 45*d*1 includes the first tube member 96*d* and the inner flow passage (inner flow tube) 93*d*.

The second section fluid tube 45*a*2 includes the second tube member 97*a* and the inner flow passage 93*a*, the second section fluid tube 45*a*2 includes the second tube member 97*b* and the inner flow passage 93*b*, the second section fluid tube 45*c*2 includes the second tube member 97*c* and the inner flow passage 93*c*, and the second section fluid tube 45*d*2 includes the second tube member 97*d* and the inner flow passage 93*d*.

The inner diameters of the first tube members 96*a*, 96*b*, 96*c*, and 96*d* are the inner diameters UR of the first section fluid tube described above, the inner diameters of the second tube members 97*a*, 97*b*, 97*c*, and 97*d* are the inner diameters DR of the second section fluid tube described above, and the inner diameters UR of the first tube members 96*a*, 96*b*, 96*c*, and 96*d* are larger than the inner diameters DR of the second tube members 97*a*, 97*b*, 97*c*, and 97*d*.

In the case where the first tube members 96*a*, 96*b*, 96*c*, and 96*d* are connected to the relay member 100, it is preferred that the inner diameters of the first tube members 96*a*, 96*b*, 96*c*, and 96*d* are the same as the inner diameters of the first section fluid tubes 45*a*1, 45*b*1, 45*c*1, and 45*d*1.

In the case where the second tube members 97*a*, 97*b*, 97*c*, and 97*d* are connected to the relay member 100, it is preferred that the inner diameters of the second tube members 96*a*, 96*b*, 96*c*, and 96*d* are the same as the inner diameters of the second section fluid tubes 45*a*2, 45*b*2, 45*c*2, and 45*d*2.

Meanwhile, the relay member 100 may include a plurality of pump ports 98 and a pump flow tube 99 to communicate the plurality of pump ports 98 with each other. In that case, the output fluid tube (the second fluid tube) includes the pump flow tube 99, and the inner diameter of the pump flow tube 99 is formed to have the inner diameter PR mentioned above.

In addition, the inner diameter of the third tube member 110 coupling the pump port 98 to the operation device 47 may be determined to be the inner diameter PR mentioned above. And, the inner diameter of the fourth tube member 111 coupling the pump port 98 to the first hydraulic pump P1 may be determined to be the inner diameter PR mentioned above.

The hydraulic system for the working machine includes a relay member 100 having the input ports 90*a*, 90*b*, 90*c*, 90*d*, the output ports 91*a*, 91*b*, 91*c*, 91*d*, the discharge port 92, the internal flow tube 93, and the discharge flow tube 94. The hydraulic system includes the first tube member 96 and the second tube member 97. The bleed circuit 60 includes the discharge flow passage (discharge flow tube) 94. Each of the first section fluid tubes 45*a*1, 45*b*1, 45*c*1, and 45*d*1 includes the first tube member 96 and the internal flow passage 93. And, the second section fluid tubes 45*a*2, 45*b*2, 45*c*2, and 45*d*2 include the second tube member 97 and the internal flow passage 93.

According to that configuration, simply by changing the inner diameters of the first tube member 96 and the second tube member 97, the inner diameters of the first section fluid tubes 45*a*1, 45*b*1, 45*c*1, and 45*d*1 and the second section fluid tubes 45*a*2, 45*b*2, 45*c*2 and 45*d*2 can be easily changed.

The inner diameter of the first tube member 96 is larger than the inner diameter of the second tube member 97. According to that configuration, only by increasing the inner diameter of the first tube member 96, a balance between the flow rate of the operation fluid outputted from the operation valve 55 and the flow rate of a part of the operation fluid discharged from the bleed circuit 60 toward the hydraulic devices 34 (the traveling pump 53L and the traveling pump 53R) can be optimized. Thus, the hydraulic device 34 can be operated efficiently.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine, comprising:
an operation device;
an operation valve to change an output pressure of an operation fluid in accordance with operation of the operation member;
a hydraulic device to be activated by the operation fluid outputted from the operation valve;
a first fluid tube coupling the operation valve to the hydraulic device; and
a bleed circuit to output the operation fluid in the first fluid tube, the bleed circuit being connected to the first fluid tube,
wherein the first fluid tube includes:
a first section fluid tube arranged in a section between the operation valve and a coupling portion coupling the first fluid tube to the bleed circuit; and
a second section fluid tube arranged in a section between the coupling portion and the hydraulic device,
and wherein an inner diameter of the first section fluid tube is different from an inner diameter of the second section fluid tube.

2. The hydraulic system according to claim 1,
wherein the inner diameter of the first section fluid tube is larger than the inner diameter of the second section fluid tube.

3. The hydraulic system according to claim 1, comprising:
a hydraulic pump to output the operation fluid; and
a second fluid tube coupling the hydraulic pump to the operation valve and having an inner diameter larger than an inner diameter of the second section fluid tube.

4. The hydraulic system according to claim 1, comprising:
a hydraulic pump to output the operation fluid; and
a second fluid tube coupling the hydraulic pump to the operation valve,
wherein the inner diameter of the first section fluid tube is larger than the inner diameter of the second section fluid tube,
and wherein the inner diameter of the second fluid tube is equal to or larger than the inner diameter of the first section fluid tube.

5. The hydraulic system according to claim 1, comprising:
a relay member including:
an input port;
an output port;
a discharge port;
an inner flow tube connecting between the input port and the output port; and
a discharge flow tube branched from the inner flow tube and connected to the discharge port;
a first tube member coupling the operation valve to the input port of the relay member; and
a second tube member coupling the hydraulic device to the output port of the relay member,
wherein the bleed circuit includes the discharge flow tube,
wherein the first section fluid tube includes the first tube member and the inner flow tube,
and wherein the second section fluid tube includes the second tube member and the inner flow tube.

6. The hydraulic system according to claim 5,
wherein the inner diameter of the first tube member is larger than the inner diameter of the second tube member.

7. The hydraulic system according to claim 2, comprising:
a hydraulic pump to output the operation fluid; and
a second fluid tube coupling the hydraulic pump to the operation valve and having an inner diameter larger than an inner diameter of the second section fluid tube.

8. The hydraulic system according to claim 2, comprising:
a hydraulic pump to output the operation fluid; and
a second fluid tube coupling the hydraulic pump to the operation valve,
wherein the inner diameter of the first section fluid tube is larger than the inner diameter of the second section fluid tube,
and wherein the inner diameter of the second fluid tube is equal to or larger than the inner diameter of the first section fluid tube.

9. The hydraulic system according to claim 3, comprising:
a hydraulic pump to output the operation fluid; and
a second fluid tube coupling the hydraulic pump to the operation valve,
wherein the inner diameter of the first section fluid tube is larger than the inner diameter of the second section fluid tube,
and wherein the inner diameter of the second fluid tube is equal to or larger than the inner diameter of the first section fluid tube.

10. The hydraulic system according to claim 4, comprising:
a hydraulic pump to output the operation fluid; and
a second fluid tube coupling the hydraulic pump to the operation valve, wherein the inner diameter of the first section fluid tube is larger than the inner diameter of the second section fluid tube, and wherein the inner diameter of the second fluid tube is equal to or larger than the inner diameter of the first section fluid tube.

11. The hydraulic system according to claim 2, comprising:

a relay member including:

an input port;

an output port;

a discharge port;

an inner flow tube connecting between the input port and the output port; and a discharge flow tube branched from the inner flow tube and connected to the discharge port;

a first tube member coupling the operation valve to the input port of the relay member, and a second tube member coupling the hydraulic device to the output port of the relay member, wherein the bleed circuit includes the discharge flow tube, wherein the first section fluid tube includes the first tube member and the inner flow tube, and wherein the second section fluid tube includes the second tube member and the inner flow tube.

12. The hydraulic system according to claim 3, comprising:

a relay member including:

an input port;

an output port;

a discharge port;

an inner flow tube connecting between the input port and the output port; and a discharge flow tube branched from the inner flow tube and connected to the discharge port;

a first tube member coupling the operation valve to the input port of the relay member; and a second tube member coupling the hydraulic device to the output port of the relay member, wherein the bleed circuit includes the discharge flow tube, wherein the first section fluid tube includes the first tube member and the inner flow tube, and wherein the second section fluid tube includes the second tube member and the inner flow tube.

13. The hydraulic system according to claim 4, comprising:

a relay member including:

an input port;

an output port;

a discharge port;

an inner flow tube connecting between the input port and the output port; and a discharge flow tube branched from the inner flow tube and connected to the discharge port;

a first tube member coupling the operation valve to the input port of the relay member; and a second tube member coupling the hydraulic device to the output port of the relay member, wherein the bleed circuit includes the discharge flow tube, wherein the first section fluid tube includes the first tube member and the inner flow tube, and wherein the second section fluid tube includes the second tube member and the inner flow tube.

14. The hydraulic system according to claim 11, wherein the inner diameter of the first tube member is larger than the inner diameter of the second tube member.

15. The hydraulic system according to claim 12, wherein the inner diameter of the first tube member is larger than the inner diameter of the second tube member.

16. The hydraulic system according to claim 13, wherein the inner diameter of the first tube member is larger than the inner diameter of the second tube member.

* * * * *